United States Patent [19]

King

[11] Patent Number: 5,056,476

[45] Date of Patent: Oct. 15, 1991

[54] VARIABLE VALVE DURATION AND LIFT FOR AN INTERNAL COMBUSTION ENGINE

[76] Inventor: Brian T. King, 48000 Elkview Road, Sardis, BC, Canada, V2R 1B1

[21] Appl. No.: 573,708

[22] Filed: Aug. 28, 1990

[51] Int. Cl.[5] ..... F01L 1/34

[52] U.S. Cl. ..... 123/90.16; 123/90.15

[58] Field of Search ..... 123/90.15, 90.16, 90.39, 123/90.44

[56] References Cited

U.S. PATENT DOCUMENTS

| | | | |
|---|---|---|---|
| 2,851,851 | 9/1958 | Smith | 123/90.16 |
| 2,934,052 | 4/1960 | Longenecker | 123/90.116 |
| 3,112,739 | 12/1963 | Peras | 123/90.16 |
| 4,502,426 | 3/1985 | Skelley | 123/90.16 |
| 4,836,155 | 6/1989 | Slagley et al. | 123/90.16 |
| 4,901,684 | 2/1990 | Wride | 123/90.16 |

FOREIGN PATENT DOCUMENTS

| | | | |
|---|---|---|---|
| 889861 | 1/1944 | France . | |
| 251500 | 10/1947 | Switzerland | 123/90.16 |

*Primary Examiner*—Willis R. Wolfe
*Assistant Examiner*—Weilun Lo

[57] ABSTRACT

A mechanism to vary the duration and lift of a valve in an internal combustion engine, wherein a lever engaging a camlobe is rotated about a fulcrum by rotation of the camlobe; the lever possessing a member to actuate a valve; the member to engage a valve being articulated with respect to the lever, and the fulcrum possessing means to displace the valve actuating member when the lever is rotated; the displacement of the valve actuating member actuating a valve. Rotation of the fulcrum of the lever alters the point in lever rotation at which the valve actuating member is displaced to actuate the valve, and determines the extent of that displacement, so that the duration and lift of the vlave may be varied relative to duration and lift of the camlobe.

14 Claims, 8 Drawing Sheets

VARIABLE VALVE DURATION AND LIFT FOR AN INTERNAL COMBUSTION ENGINE

BACKGROUND OF THE INVENTION

It is recognised in the art that non-variable valve duration is no more acceptable, from the point of view of engine efficiency, than would be non-variable ignition timing, or non-variable fuel metering.

Variable valve duration, especially when combined with variable valve lift, even when embodied in a form which tends to optimise duration and lift at only two infinitely narrow points on the speed range of an engine—as with Honda's current production two-stage system—demonstrates, among other advantages, that the superior torque curve that results allows addition of catalystic converters to control emissions without serious and wasteful loss of torque either side of the torque peak, as is the case with non-variable valve duration engines so equipped.

Obviously, valve duration and lift that is optimal at every point on the engine speed scale, and for all conditions of engine operation, would be proportionately superior to a two stage system as discussed, and by virtue of offering a predictable baseline of induction and exhaust control throughout the engine speed range, would offer opportunities to maximize fuel useage, and minimize polluting emissions, factors of crucial importance today and into the future.

Of the many systems proposed to achieve variable valve duration, one system that has often appeared is based on the principle of progressively disengaging the valve from the camlobe that drives it, thereby reducing the duration of the valve relative to the duration of the camlobe. Various mechanisms are proposed to achieve this; but suffer from the fact that, in reducing valve duration relative to camlobe duration, the opening and closing phases of camlobe profile are no longer in effect, with the result that the initial, and final, opening and closing phases, respectively, of valve motion are subject to unacceptable positive and negative acceleration rates, leading to rapid valve gear wear, and erratic valve action.

Accordingly, a system is proposed that compensates for the above mentioned problems.

SUMMARY OF THE INVENTION

An object of the present invention is to provide continuously variable valve duration and lift in an internal combustion engine.

To achieve this object, it is proposed that a camlobe shall, by rotation, rotate a lever engaging the camlobe; rotation of the lever causing displacement of a member connected operatively to the lever, the displacement of this member displacing a valve to open and close.

Displacement of the aforesaid member is effected, during rotation of the lever, by bringing a first portion of the member into contact with a ramp-like section formed on the fulcrum about which the lever rotates; reverse rotation of the lever under control of the closing flank of the camlobe allowing the displaced member to return to its initial position. The aforesaid displaceable member having also a portion to engage a valve, displacement of the member will open a valve, while in response to opposite rotation of the lever, return of the member to its initial position, will close the valve.

In order to control the duration of the valve relative to duration of the camlobe, the fulcrum of the lever is rotatable sufficiently to alter the point at which engagement, and disengagement, of the displacable member, with the ramp-like displacing section of the lever fulcrum takes place, relative to rotation of the lever, and, thus, relative to rotation of the camlobe. In this manner, valve duration, defined by the opening and closing points of valve actuation, may be varied relative to the fixed duration of the camlobe.

Additionally, valve lift will, by virtue of the varying geometry of the apparatus when producing varying valve duration, be varied so as to increase as engine speed increases, and vice versa.

It is a further object of the present invention that acceptable valve accelerations be maintained throughout the operating range of the engine.

To achieve this object, it is proposed that the initial, and final, stages of the open phase of valve operation be determined, not solely by the so-called opening and closing sections of the camlobe, but, at least in part, by sections of the ramp-like displacement portion of the lever fulcrum, these sections being so profiled as to modify, in translation, whatever positive and negative accelerations are imparted to the lever by the camlobe, so as to provide, regardless of the sections of the camlobe in effect during the opening and closing phases of the valve, valve accelerations tending towards a value commensurate with acceptable valve train wear.

DETAILED DESCRIPTION OF THE PREFERRED EMBODIMENTS

Figure 1:
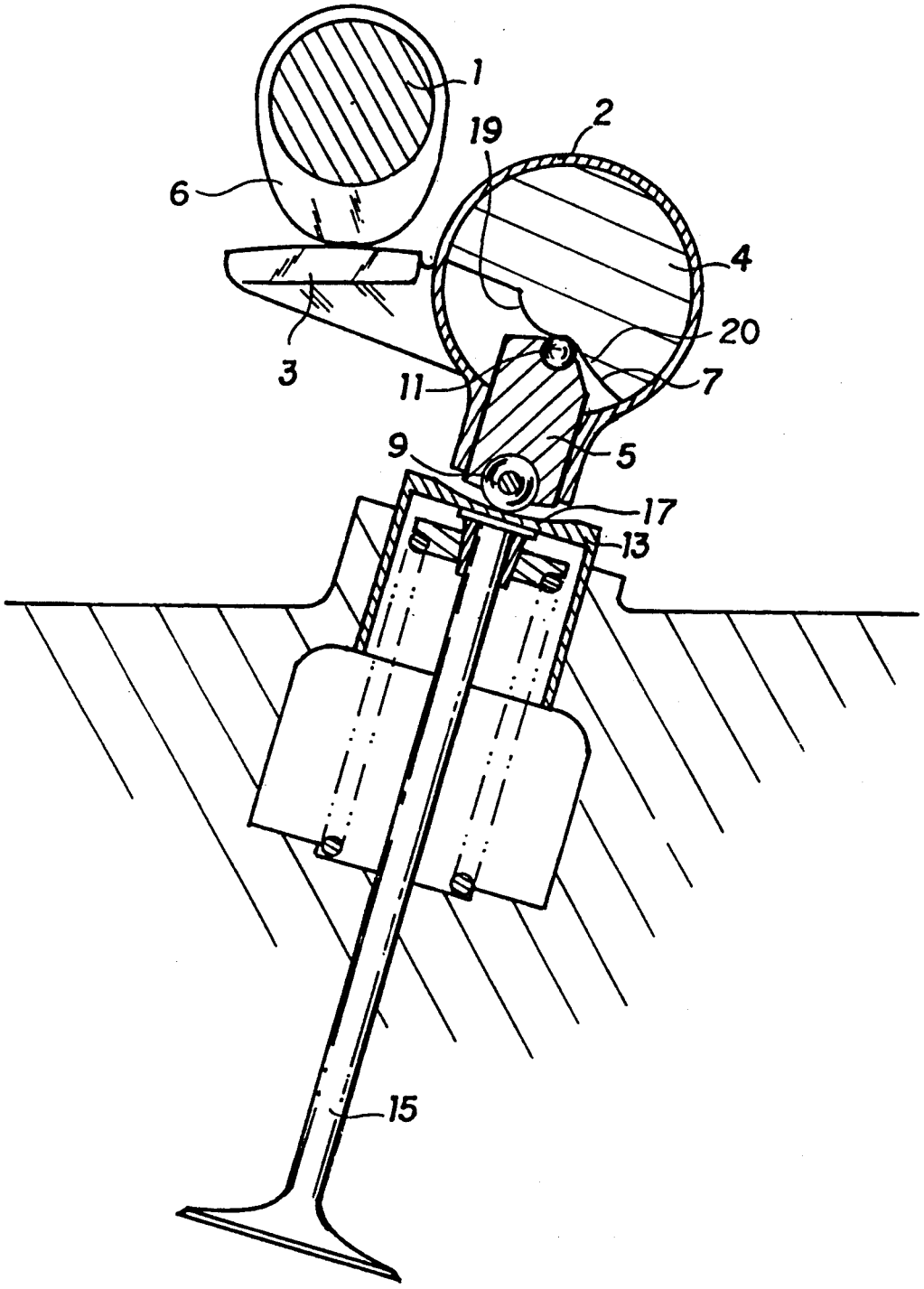
FIG. 1. Shows a first embodiment of the invention.
Figure 9:
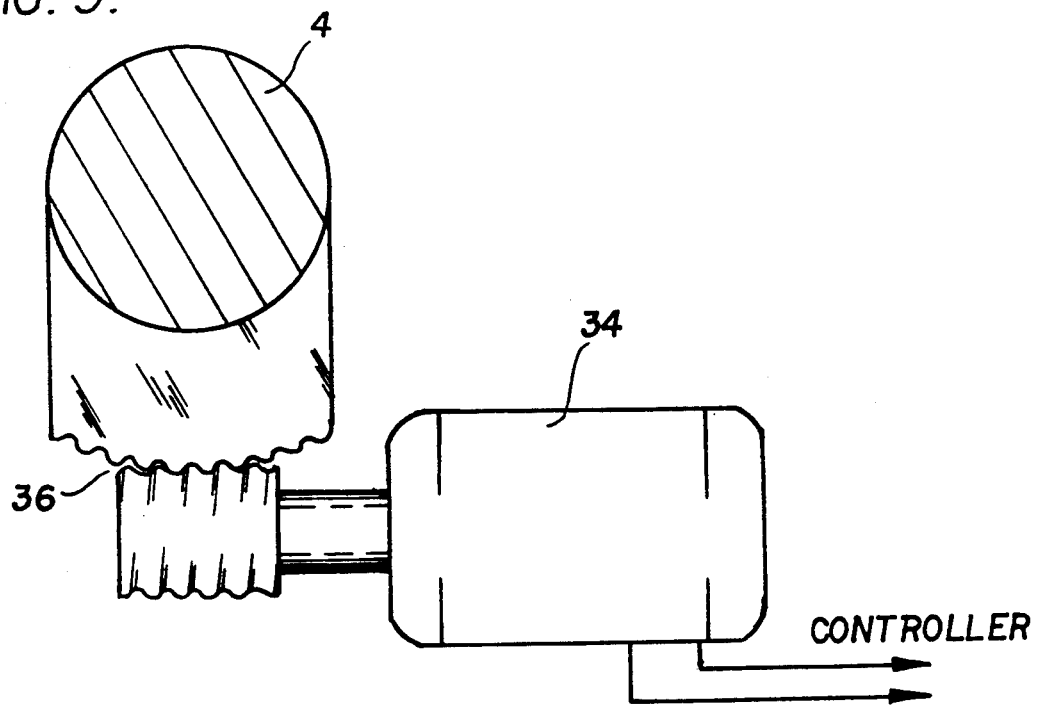
FIG. 9. Shows a control means for invention.

FIG. 1 shows a preferred embodiment of the present invention. It should be noted that in this depiction, fulcrum 4 is rotated so as to produce no valve displacement during camlobe 6 rotation. Camshaft 1 carries camlobe 6; cam follower 3 of first lever 2 is engaged by camlobe 6. First lever 2 rotates about fulcrum 4, and houses reciprocatively valve engagement member 5 which engages operatively both valve 15 and curvilinear section 7 of fulcrum 4. Valve engagement member 5 of first lever 2 has a pivoted roller 11 to engage section 7 of first lever 4, and a pivoted roller 9 to engage valve 15. Interposed between roller 9 of valve engagement member 5 and valve 15 is bucket tappet 13 having a concave surface 17 described by rotation of a radius about the axis of fulcrum 4 with valve 15 in a closed position. Fulcrum 4 is rotatable within predetermined limits by any suitable control system of per se well known type—including hydraulic, electrical and mechanical means and the like. FIG. 9 shows fulcrum 4 controlled by an electric motor 34 and worm gearing 36. In practice, camshaft 1 rotates in synchronism with the engine crankshaft so as to displace cam follower 3 of first lever 2; first lever 2, thereby, being rotated about the axis of its fulcrum 4. Valve engagement member 5 of first lever 2 is caused to rotate by rotation of its housing, first lever 2, so as to bring roller 11 of valve engagement member 5 of first lever 2 into contact with curvilinear section 7 of fulcrum 4.

Figure 2A:
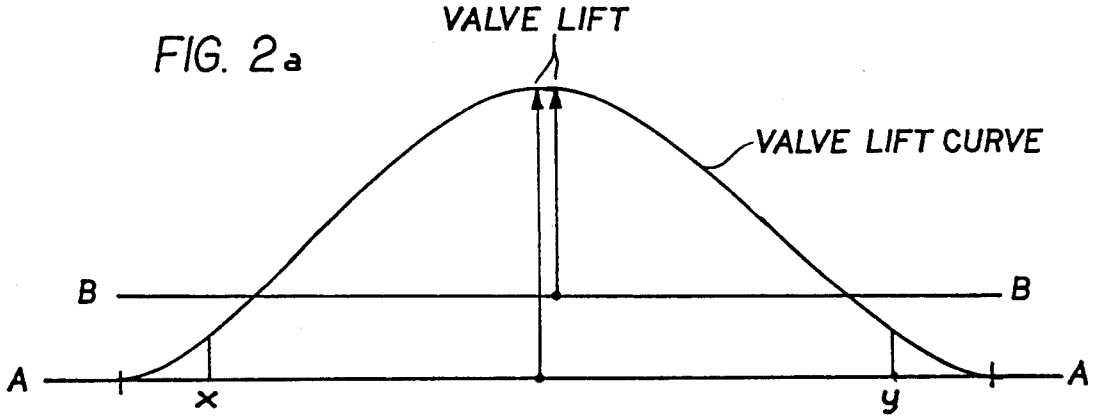
FIG. 2*a* and 2*b*. Depict curves of valve lift at various durations.

As shown in FIG. 2, the aforesaid curvilinear section 7 of fulcrum 4 comprises a plurality of sections of diverse curvature connected together in a continuous manner. One section of curvilinear section 7 is an arc described by rotation of a radius about the axis of fulcrum 4, and, in cooperation with the aforesaid concave surface 17 of bucket tappet 13, is a preferred feature to ensure maintenance of a predetermined valve clearance with valve 15 in a closed position and, as required, during rotation of first lever 2.

Figure 3:
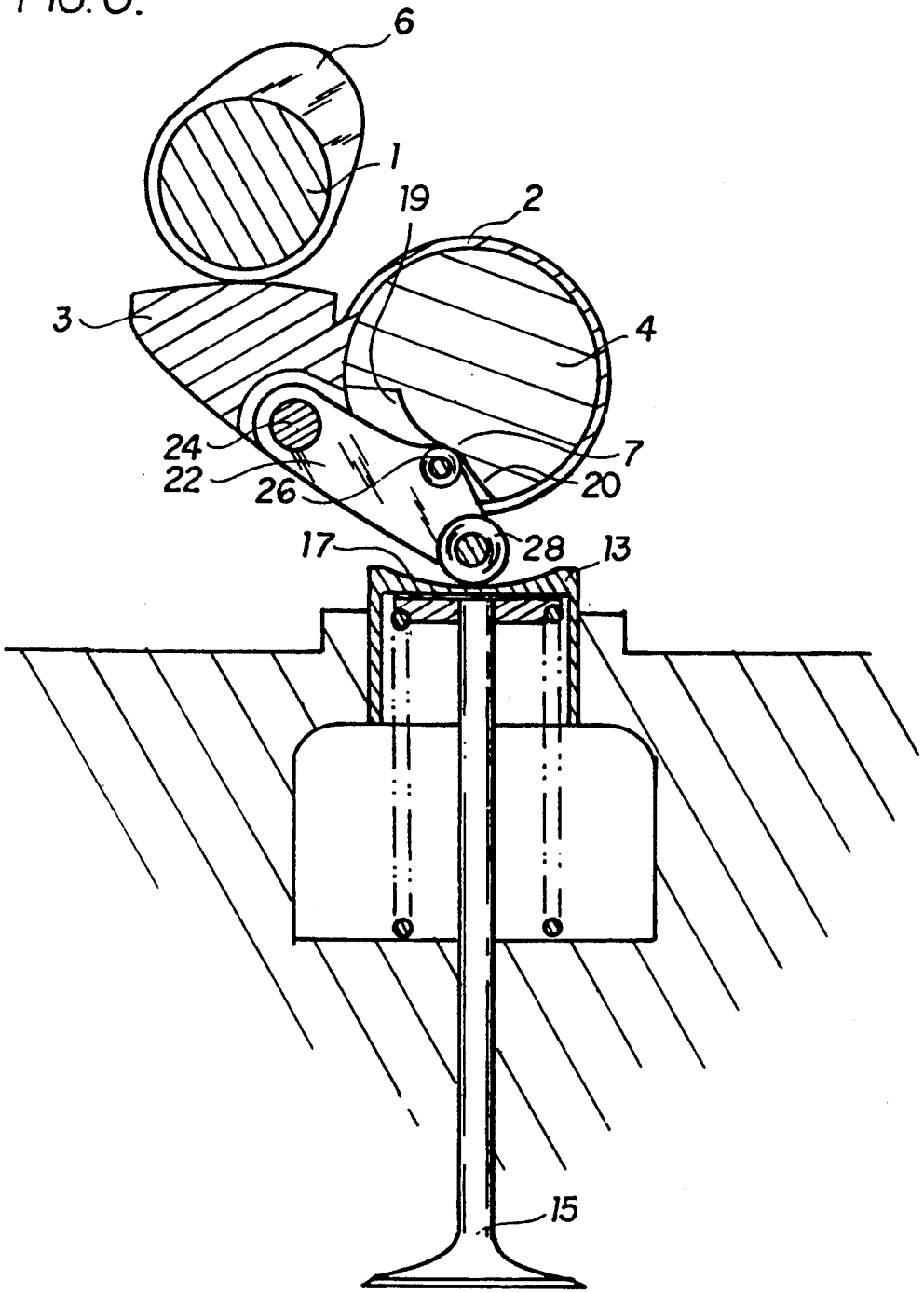
FIG. 3. Shows another embodiment of the invention.

To maintain correct operational orientation of bucket tappet 13 relative to roller 28 in the embodiment in FIG. 3, or to roller 9 in the embodiment in FIG. 1, thus ensuring proper engagement between roller and bucket tappet, bucket tappet 13 may be prevented from rotating within its bore by means of a first component having a track bearing a groove parallel to the axis of bucket tappet 13; the groove being engaged operatively by a projection, or pin, defined by portions of the second component.

An alternative system to maintain correct engagement between bucket tappet 13 and roller 9 (or 28) comprises the concave surface 17 of bucket tappet 13 being defined by a segment of the surface of a sphere, and roller 9 (or 28) having its form defined by rotation, at a constant radius, of a line representing a part of the circumference of an identical sphere about the axis of roller 9 (or 28).

Specifically, rotation of first lever 2 causes no displacement of valve engagement member 5 of first lever 2 as long as roller 11 of valve engagement member 5 of first lever 2 engages section of curvilinear section 7 of fulcrum 4. When, however, roller 11 of valve engagement member 5 of first lever 2 is brought, by the aforesaid rotation of first lever 2, into contact with ramp-like section 20 of curvilinear section 7 of fulcrum 4, valve engagement member 5 of first lever 2 is displace so as to extend from its housing in first lever 2, said extension displacing bucket tappet 13, which in turn displaces valve 15 to the open position.

Reciprocally, opposite rotation of first lever 2 controlled by the closing flank of the rotating camlobe 6 permits roller 11 of valve engagement member 5 of first lever 2 to descend section 20 of curvilinear section 7 of fulcrum 4, returning valve 15 to its initial position.

Valve engagement member 5 is biased into contact with fulcrum 4 by biasing spring of per se well known type (not shown); while cam follower 3 is biased into contact with camlobe 6 by biasing spring of per se well known type (not shown).

It will be seen, therefore, that rotational motion of first lever 2 is translated into substantially reciprocating motion of valve engagement member 5 of first lever 2 so as to actuate a valve 15; and that the timing, extent, and rate, of this motion is dependant on such various factors as the position of section 20 of curvilinear section 7 of fulcrum 4 relative to rotation of first lever 2; and the profile and angle of the aforesaid section 20 of curvilinear section 7 of fulcrum 4.

It will be recognized, therefore, that by rotation of fulcrum 4 between predetermined limits, in response to one or more engine demand requirements, by the means hereinbefore described, the timing of the opening and closing phases of valve 15 may be varied so as to vary the duration of the open period of valve 15 relative to the opening and closing points of camlobe 6 as determined by its profile; it being understood in the art that, generally, apart from steady state cruising conditions and the like, it is desirable that valve duration and lift increase with engine speed and vice versa. Specifically, if fulcrum 4 is rotated so as to cause roller 11 of valve engagement member 5 of first lever 2 to contact section 20 of curvilinear section 7 of fulcrum 4 at a point relatively later in first lever 2 rotation, the valve 15 will be caused to open later, and close earlier, relative to camlobe 6, and, therefore, relative to crankshaft revolution; the converse being true if fulcrum 4 is rotated in the opposite direction. It will be seen, therefore, that by suitable rotation of fulcrum 4 the duration of valve opening may be varied between predetermined limits.

FIG. 2 further depicts the relationship between increasing valve duration and increasing valve lift.

Figure 4:
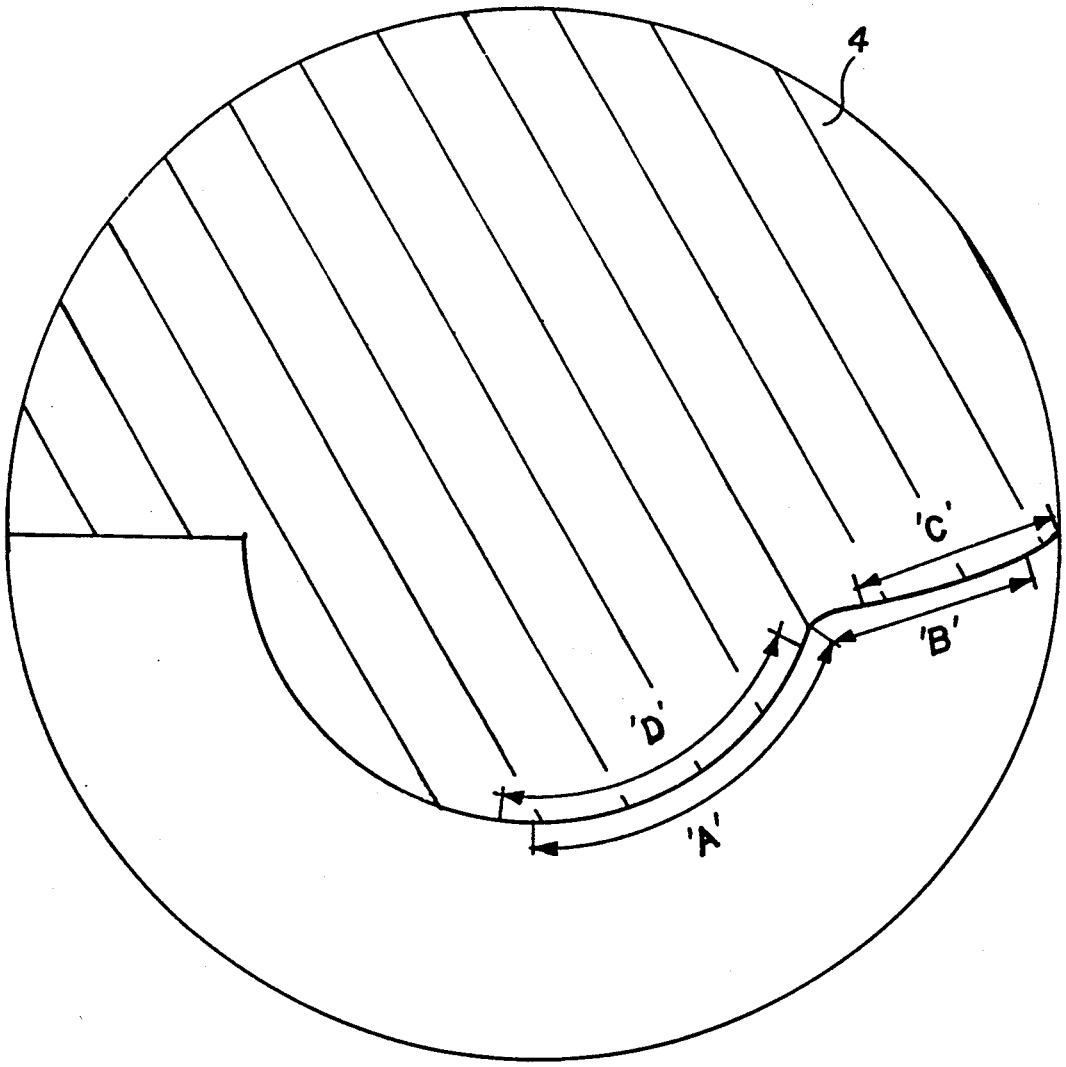
FIG. 4. Shows details of fulcrum control surfaces of the apparatus.

FIG. 4 further depicts curvilinear section 7 of fulcrum 4, with different portions of this section related to various valve durations. Specifically, section 'A' identifies the section in effect during maintenance of correct valve clearances; section 'B' identifies the section in effect within the normal range of valve opening; section 'D' identifies the section in effect during non-opening of the valve relative to a camshaft revolution; section 'C' identifies the section in effect during non closing of the valve relative to a camshaft revolution. Fulcrum 4 may be sufficiently rotated by control means to bring into effect each of these aforesaid section, as desired.

A further important aspect of the present invention lies in the manner in which the motions generated by the camlobe are imparted to the valve at various durations of the valve; it being necessary, if acceptable accelerations of the valve are to be achieved at durations less than those determined by the full camlobe profile, to provide a means to reduce the initial opening and final closing rates of the valve below those determined, in translation, by the high acceleration rate sections of the camlobe profile brought into effect on the valve during its opening and closing phases at reduced durations.

Accordingly, it is, preferably, a feature of the present invention that the acceleration rates of the valve be determined, not solely by the camlobe profile, but also, at least in part, by the profile of curvilinear section 7 of fulcrum 4; specifically that the appropriate sections of curvilinear section 7 of fulcrum 4 be so profiled as to afford acceptable valve opening and closing rates regardless of the portions of the camlobe 6 profile in effect during the opening and closing phases of the valve 15. Further, that any part of the valve motion may be determined, at least in part, by the profile of aforesaid curvilinear section 7 of fulcrum 4. FIG. 2 depicts, in a general way, this feature, as follows:

At a valve duration determined by a typical camlobe, drawn on baseline A—A, it is seen that the initial opening phase, and the final closing phase of a valve, are, relatively, at reduced positive and negative accelerations, depicted by the valve lift curves between points A—X, and Y—A respectively.

When valve duration is reduced relative to camlobe duration, as depicted on baseline B—B, the portions of the camlobe that provide the aforesaid necessary reduced accelerations of the valve are less in effect, or, are not in effect at all, and, therefore, the initial and final valve motions of the valve open period are excessively violent, being generated by the high acceleration rate (positive and negative) section of the camlobe in effect during the opening and closing valve phases.

Figure 2B:
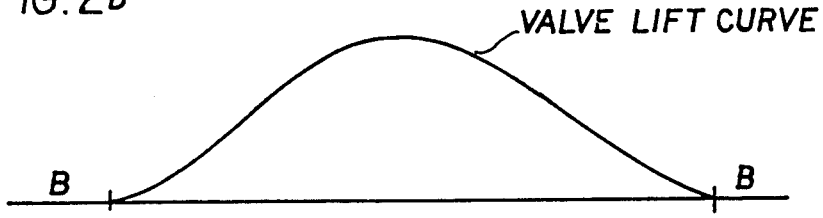
Figure 5:
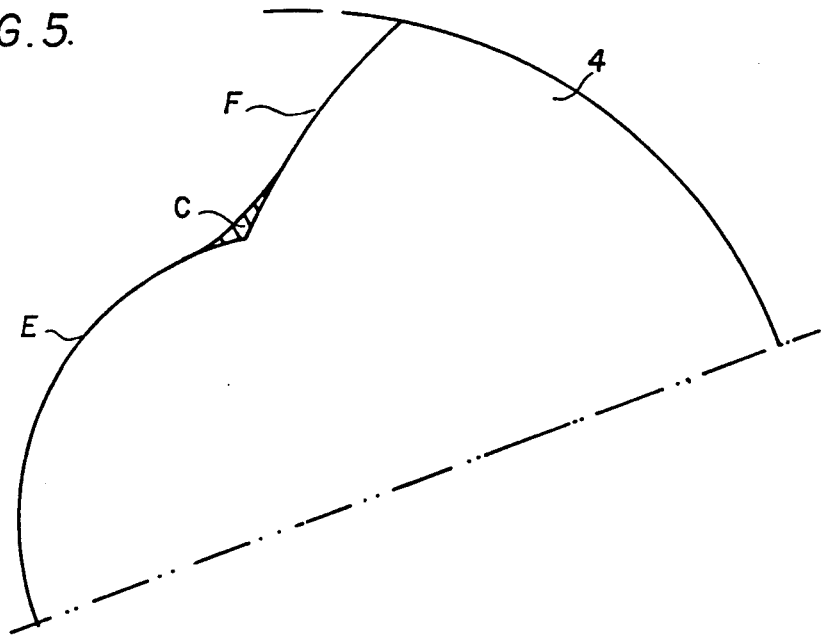
FIG. 5. Depicts further details of fulcrum control surfaces of the apparatus.

To compensate for this effect, it is a preferred feature of the invention that the curvilinear section 7 of fulcrum 4 be so profiled that valve motion is not a direct translation of the positive and negative accelerations of the camlobe; but is modified, in translation, so that regardless of the section of camlobe profile in effect during the opening and closing phases of valve travel, an initial, and final, rate of acceptably reduced valve acceleration is realised. FIG. 2*b* depicts this, with valve lift curve B—B from FIG. 2*a* so modified. Further elucidation of this preferred feature is offered in FIGS. 5 and 6; FIG. 5 showing a portion of curvilinear section of fulcrum 4. Section 'E' is so profiled as to facilitate a predetermined valve clearance, while Section 'F' is a ramp-like section to displace, so as to actuate valve 15, first lever member 5 of the embodiment shown in FIG. 1; or second lever 22 of the embodiment shown in FIG. 3.

It will be noted that Section 'C' connects Section 'E' and Section 'F' of curvilinear section of fulcrum 4; and that the profile of Section 'C' is such that a gradual transition between Sections 'F' and 'E' is thereby provided.

Figure 6:
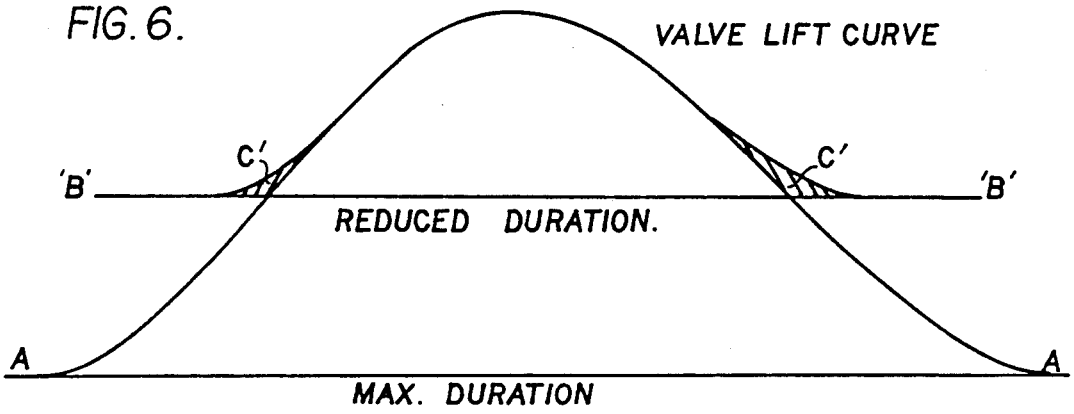
FIG. 6. Depicts curves of valve lift at various durations.

In practice, Section 'C' modifies, at reduced valve durations, the opening and closing rates of valve 15 relative to the high acceleration rates of the camlobe 6 in effect at durations less than that of the camlobe 6. This is shown in FIG. 6; Section 'C' representing the aforesaid modification of valve lift rates at reduced valve duration represented on baseline B—B.

It is, preferably, a further feature of the present invention that the camlobe profile be such as to achieve, in cooperation with the profile of curvilinear section 7 of fulcrum 4, suitable valve accelerations throughout the range of valve durations determined by the present mechanism.

FIG. 3 shows a further preferred embodiment of the present invention in the use of a second lever 22 pivoted to first lever 2 by second lever fulcrum 24; the aforesaid second lever 22 replacing valve engagement member 5 of first lever 2 as hereinbefore described in another embodiment depicted in FIG. 1.

Second lever 22 has a roller 26 to engage curvilinear section 7 of fulcrum 4, and a roller 28 to engage concave section 17 of bucket tappet 13. Rotation of first lever 2 in response to rotation of camlobe 6, brings roller 26 into contact with section 20 of curvilinear section 7 of fulcrum 4 so as to displace roller 26 of second lever 22. Displacement of second lever 22, through the medium of roller 28 displaces bucket tappet 13, thus opening valve 15. Conversely, opposite rotation of first lever 2 returns second lever 22 to it's initial position, closing valve 15.

Figure 7:
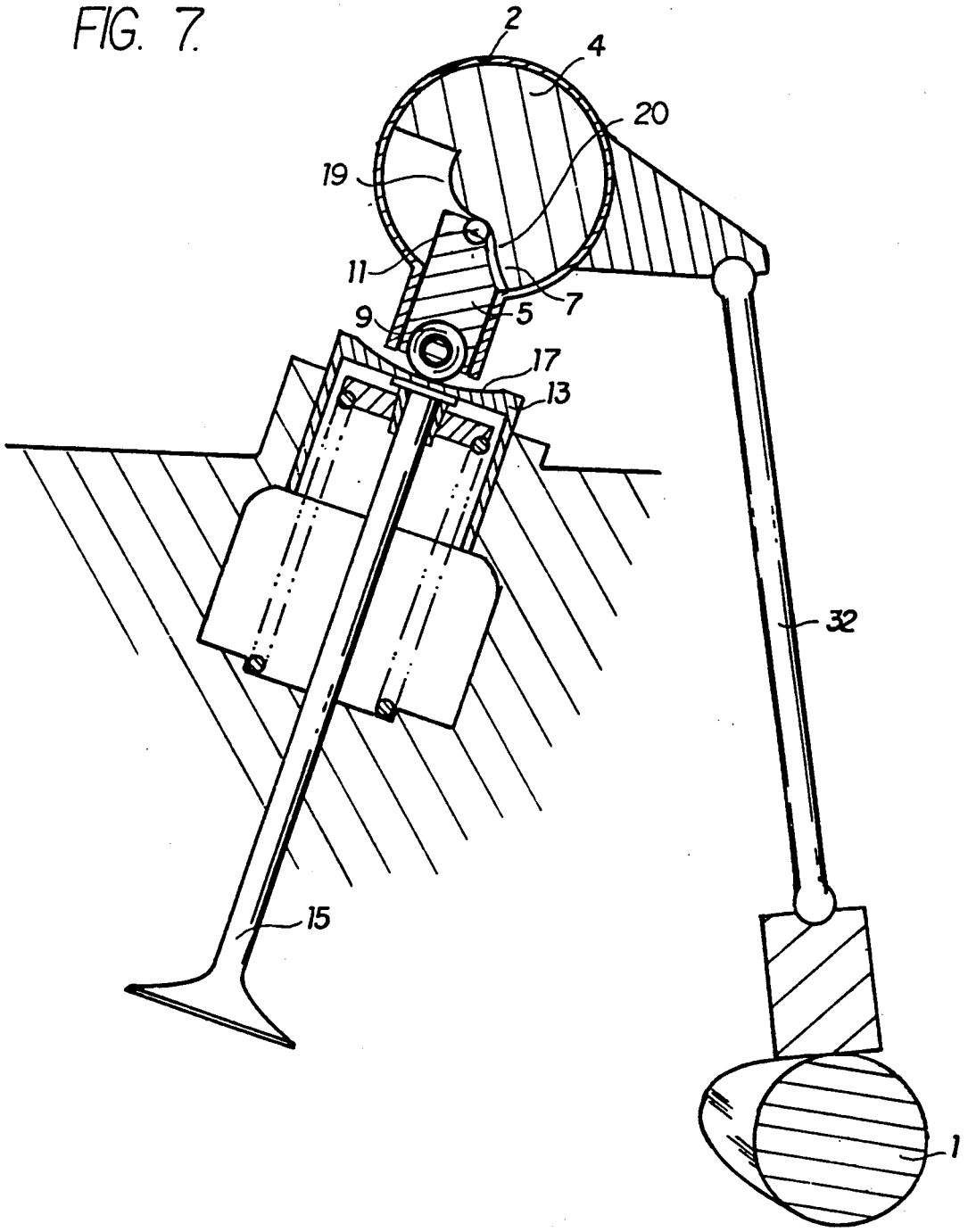
FIG. 7. Shows another embodiment of the invention.

A further embodiment of the present invention lies in the use, as shown in FIG. 7, of a mechanism as hereinbefore described, to be actuated by a pushrod 32 actuated by camshaft 1, said camshaft 1 being remotely situated, relative to the aforesaid mechanism.

Figure 8:
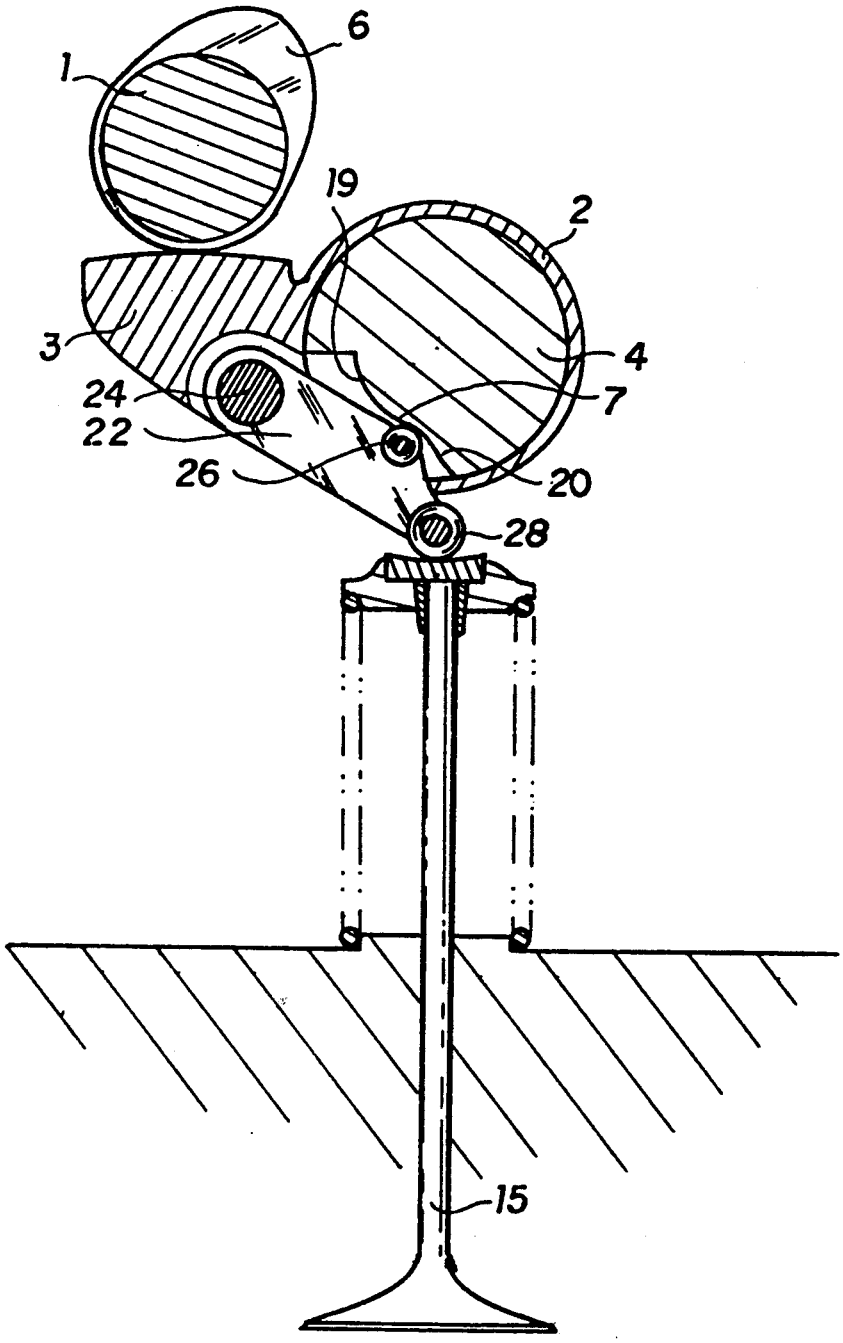
FIG. 8. Shows another embodiment of the invention.

An alternative embodiment lies in the employment of a geometric relationship between first lever 2, and second lever 22 suitable to allow roller 28 to engage valve 15 without use of a bucket tappet. See FIG. 8.

Other factors of control, profiling of curvilinear section 7 of fulcrum 4, and so forth, that are hereinbefore described regarding the embodiment shown in FIG. 1 apply to the embodiment shown in FIG. 3 and FIG. 7.

Preferably, both valve engagement member 5 of first lever 2 shown in FIG. 1, and second lever 22 in FIG. 3 are biased, in their respective embodiments, by spring means (not shown) into engagement with the curvilinear surface 7 of fulcrum 4.

It is a further aspect of the present invention that the rollers depicted and described in this specification may be replaced by non-articulated slipper-type engagement surfaces of per se well known type.

It is a yet further aspect of the present invention that slipper-type cam follower 3 shown in FIGS. 1 and 3, may be replaced by a roller type cam follower of per se well known type.

It is another aspect of the present invention that curvilinear section 7 of fulcrum 3 may be so shaped as to permit, by appropriate rotation of fulcrum 4, valve 15 to remain closed throughout full rotation of camlobe 6; or alternately to remain open throughout full rotation of camlobe 6. This is depicted in FIG. 4 and is a feature that facilitates engine braking and disablement of a cylinder, respectively.

It is yet another aspect of the present invention that exhaust valves may, during the warm-up phase of the engine, be caused, as hereinbefore described, to open at a timing sufficiently retarded, in terms of crankshaft rotation, to increase heat input of the exhaust gases into the cylinder, cylinder head, and valves, so as to decrease the engine warm up period, and the duration of fuel mixture enrichment necessary during this period.

It is yet another feature of the present invention that by controlling valve phasing, as hereinbefore described, pumping losses associated with the necessity to reduce engine power under certain conditions, by using a throttle valve in the inlet tract to limit the amount of air admitted to the cylinder, may be reduced by using valve phasing to control the amount of air admitted to the cylinder. Specifically, by freely admitting air, at substantially atmospheric pressure, to the cylinder, then, by delaying the closing of the intake valve, allowing a certain proportion of the intake air to be pumped, by the rising piston, back past the intake valve into the induction tract, the amount of engine power produced may be controlled without the power wasteage normally encountered in a system in which power is limited by forcing the pistons to descend against the negative pressure generated by a closed, or partially closed, throttle valve.

What is claimed is:

1. A mechanism to actuate a valve in an internal combustion engine, comprising:

a camshaft carrying a camlobe;

a fulcrum rotatable about its own axis;

a first lever rotatable about the axis of said fulcrum, and having both camfollower means to engage said camlobe for rotation of said first lever by rotation of said camlobe, and means for engaging operatively said valve, said means for engaging operatively said valve being extensible relative to said first lever so as to actuate said valve;

means for extending, relative to said first lever, said means for engaging operatively said valve, so as to actuate said valve when said first lever is rotated by rotation of said camlobe;

said fulcrum having means for varying the phase relationship between rotation of said first lever rotated by rotation of said camlobe, and extension, relative to said first lever, of said means for engaging operatively said valve, so as to vary the duration and lift of said valve relative to the duration and lift of said camlobe.

2. The mechanism as in claim 1 wherein said means for varying the phase relationship between rotation of said first lever rotated by rotation of said camlobe, and extension, relative to said first lever, of said means for engaging operatively said valve, comprises:

said means for engaging operatively said valve having means for engaging operatively said fulcrum;

said fulcrum having means for displacing, relative to said first lever, said means for engaging operatively said valve, so as to actuate said valve, when said first lever is rotated about said fulcrum by rotation of said camlobe, and means for rotating said fulcrum, so as to vary the phase relationship between rotation of said first lever rotated by said camlobe, and displacement of said means for engaging operatively said valve, said varying phase relationship between rotation of said first lever, and displacement of said means for engaging operatively said valve varying the duration and lift of said valve relative to the duration and lift of said camlobe.

3. The mechanism as in claim 2, wherein said means for displacing, relative to said first lever, said means for engaging operatively said valve, so as to actuate said valve, comprises:

a curvilinear surface defined by portions of said fulcrum, said curvilinear surface being engaged operatively by said means for engaging operatively said valve, and being suitably profiled to displace said means for engaging operatively said valve, so as to actuate said valve, when said first lever is rotated about said fulcrum by rotation of said camlobe.

4. The mechanism as in claim 2 wherein said means for engaging operatively said valve comprises:

a member reciprocatively received in a housing defined by portions of said first lever, and having means to engage said fulcrum, and means to engage said valve.

5. The mechanism as in claim 2 wherein said means for engaging operatively said valve comprises:

a second lever;

said first lever having means to engage pivotally said second lever;

said second lever having means to engage operatively said fulcrum, and means to engage operatively said valve.

6. The mechanism as in claim 3 further comprising:

said curvilinear surface defined by portions of said fulcrum having means to determine, at least in part, the acceleration and deceleration rates of said valve, during the open phase of said valve, relative to the acceleration and deceleration characteristics of said camlobe.

7. The mechanism as in claim 6 further comprising:

said camlobe being so profiled as to provide, in cooperation with said curvilinear surface defined by portions of said fulcrum to displace operationally said valve, valve acceleration and deceleration rates tending towards an optimum value.

8. The mechanism as in claim 1, further comprising:

said valve having means for engaging said means of said first lever to engage said valve, so as to facilitate maintenance of a predetermined operating valve clearance, with said valve in a closed position, said means being tappet means to engage operatively said means of said first lever to engage said valve, said tappet means having a surface to engage said means of said first lever to engage said valve defined by rotation of one or more radii about the axis of said fulcrum means, the length of said one or more radii being sufficient to provide a predetermined operating clearance between said means of said first lever to engage said valve and said tappet means.

9. The mechanism as in claim 3 further comprising:

said curvilinear surface defined by portions of said fulcrum to engage a valve, having means to facilitate maintenance of a predetermined operating valve clearance, with said valve in a closed position.

10. The mechanism as in claim 2, wherein said means for engaging operatively said valve and said fulcrum further comprises:

means for biasing said means for engaging operatively said valve and said fulcrum into engagement with said fulcrum.

11. The mechanism as in claim 3, further comprising a cylinder;

a cylinder head;

one or more exhaust valves;

said one or more exhaust valves being delayed in opening by an amount sufficient to increase heat input into said cylinder, said cylinder head, and said one or more exhaust valves, so as to decrease the time required for said cylinder, said cylinder head, and said one or more exhaust valves, to reach normal operating temperature.

12. The mechanism as in claim 3, including an internal combustion engine having a cylinder, a piston, and a cylinder head having one or more intake valves, said mechanism further comprising:

means to control inlet valve phasing so as to regulate the volume of air retained in said cylinder during the compression stroke;

said inlet valve phasing permitting regulation of engine power, and, by virtue of substantially atmospheric pressure acting on said piston during the induction stroke, minimization of pumping losses associated with said induction stroke.

13. The mechanism as in claim 1 wherein said cam follower means to engage said camlobe further comprises:

a pushrod;

said pushrod being operatively interposed between said camlobe, and means of said first lever for engaging operatively said pushrod.

14. The mechanism as in claim 2 wherein said means for rotating said fulcrum comprises:

an electric motor;

said fulcrum having gearing means to engage operatively said electric motor;

said electric motor having gearing means to engage said gearing means of said fulcrum, and being responsive to control means.

* * * * *